US005651755A

United States Patent [19]

Chen

[11] Patent Number: 5,651,755

[45] Date of Patent: Jul. 29, 1997

[54] HAND-HELD EXERCISER

[76] Inventor: Ping Chen, No. 29, Nan-Mei St., Taichung City, Taiwan

[21] Appl. No.: 688,392

[22] Filed: Jul. 30, 1996

[51] Int. Cl.[6] ..... A63B 21/02

[52] U.S. Cl. ..... 482/128; 482/126

[58] Field of Search ..... 482/121, 122, 482/126, 128

[56] References Cited

U.S. PATENT DOCUMENTS 4,863,162 9/1989 Neckamm et al. ..... 482/128

5,160,304 11/1992 Van Der Hoeven ..... 482/128

*Primary Examiner*—Lynne A. Reichard

*Attorney, Agent, or Firm*—Ladas & Parry

[57] ABSTRACT

A hand-held exerciser a fixed body, a movable body, and a coiled spring. The fixed body has an abutting plate and a tube member connected perpendicularly one another. The tube member has a longitudinal opening which extends from the distal end of tube member to the abutting plate. A catch member is connected transversely to the distal end of the tube member. The movable body has a central tubular portion and two wing members connected to two sides of the central tubular portion. Each of the wing members is formed with a handle. The central tubular portion has an engaging seat and an axial notch. The tube member is fitted slidably in the central tubular portion. The coiled spring is received in the tube member and interconnects the engaging seat of the movable body and the distal end of the tube member in order to urge the catch member to abut against of the bottom end of the axial notch of the movable body.

2 Claims, 9 Drawing Sheets

HAND-HELD EXERCISER

BACKGROUND OF THE INVENTION

1. Field of the Invention

This invention relates to an exerciser, more particularly to a hand-held exerciser.

2. Description of the Related Art

Referring to FIG. 1, a conventional exerciser is shown to comprise a fixed body 1, a movable body 2, a coiled spring 3 and a spring adjustment device 4. The fixed body 1 has an elongated base plate (1*a*), an upright outer tube (1*b*) connected to the base plate (1*a*) at its lower end, and a fastening device (1*c*) which is mounted under the lower end of the outer tube (1*b*) in order to connect rotatably the outer tube (1*b*) to the fixed body 1. The lower side of the base plate (1*a*) defines substantially a planar, flat support surface in order to be disposed stably on the ground. The movable body 2 has a transverse press bar (2*a*) and an inner tube (2*b*) connected perpendicularly to the transverse bar (2*a*) at its upper end. The lower portion of the inner tube (2*a*) is received slidably in the outer tube (1*b*). The coiled spring 3 is disposed in the inner tube (2*a*). The spring adjustment device 4 has a threaded rod (4*c*) which has a head (4*d*) that engages a rotary knob (4*a*), and a nut member (4*b*) connected to its lower end. The spring force of the coiled spring 3 can be increased or decreased by means of rotating the rotary knob (4*a*) and thereby the threaded shaft (4*c*), causing the nut member (4*b*) to move relative to the threaded shaft (4*c*) and to compress or release the coiled spring 3.

In use, the user may place the base plate (1*a*) of the fixed body 1 on the ground and depress the movable body 2 downward against the spring force of the coiled spring 3 for exercising purposes. However, because the weight of the user's body facilitates the depression of the movable body 2 when the user normally bends his/her body to depress the movable body 2 downward by means of arms, the user cannot simply exercise his/her arms by means of the conventional exerciser.

SUMMARY OF THE INVENTION

It is therefore a main object of the present invention to provide a hand-held exerciser which can be used to simply exercise the user's arms as desired.

According to the present invention, the hand-held exerciser comprises:

a fixed body having an abutting plate and a tube member extending perpendicularly from one of the opposed side faces of the abutting plate, the tube member having a longitudinal opening which is formed in the wall thereof and which extends from the distal end thereof toward the abutting plate, the distal end of the tube member having a catch member connected transversely thereto;

a movable body having a central tubular portion and two wing members connected to two sides of the central tubular portion, each of the wing members being formed with a handle, the central tubular portion having an open end, a closed end, an engaging seat fixed adjacent to the open end thereof, a plurality of projections formed on the internal face thereof adjacent to the closed end thereof, and an axial notch extending from the closed end thereof, the tube member of the fixed body being fitted slidably in the central tubular portion of the movable body with the catch member of the fixed body being received slidably in the axial notch of the movable body; and a coiled spring received in the tube member of the fixed body and having a first end which is connected to the engaging seat of the movable body and a second end which is connected to the distal end of the tube member in order to urge the catch member to abut against the bottom end of the axial notch of the movable body.

BRIEF DESCRIPTION OF THE DRAWINGS

Other features and advantages of this invention will become apparent in the following detailed description of a preferred embodiment of this invention with reference to the accompanying drawings, in which.

DETAILED DESCRIPTION OF THE PREFERRED EMBODIMENT

Figure 1:
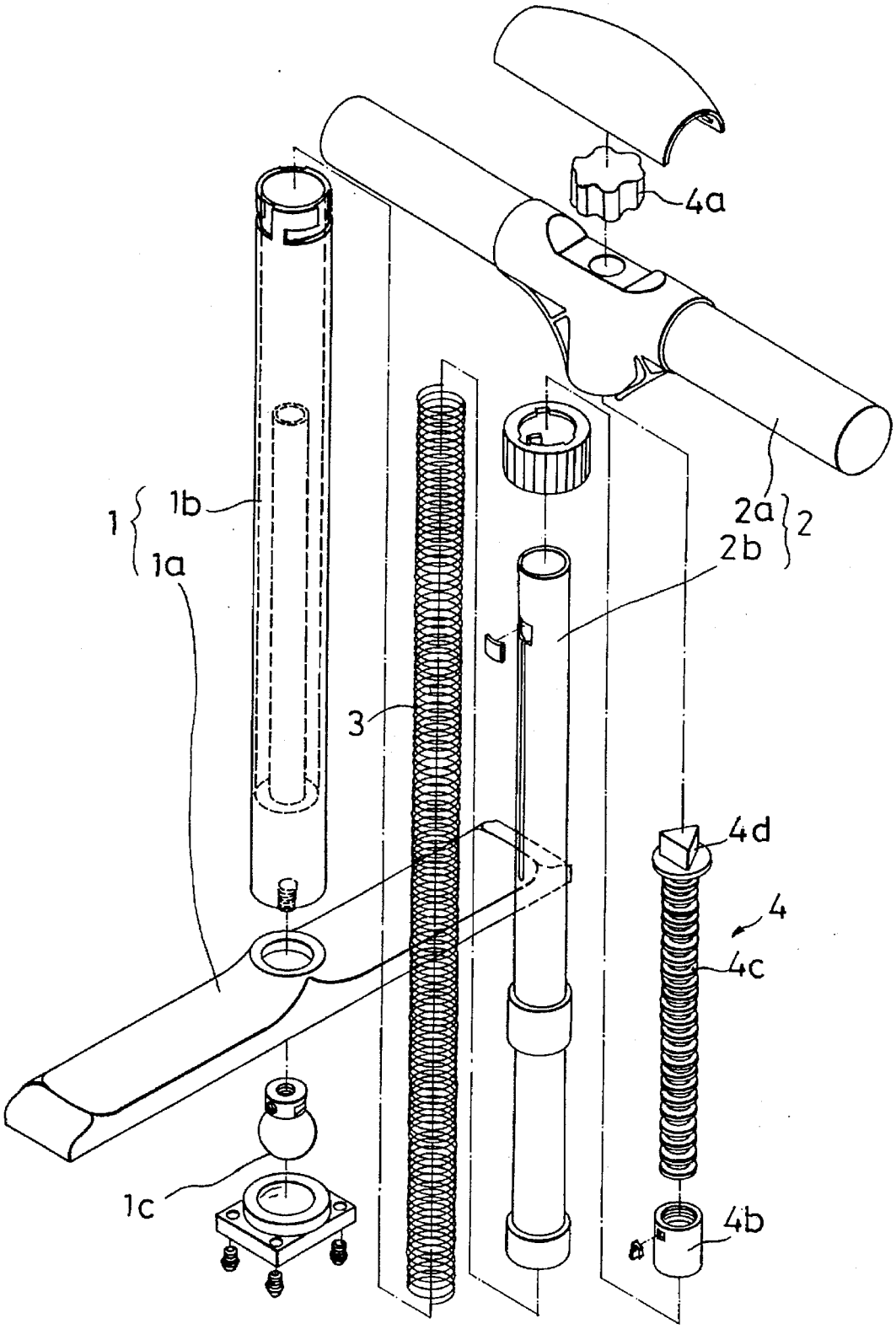
FIG. 1 PRIOR ART
FIG. 1 is a perspective exploded view of a conventional exerciser.
Figure 2:
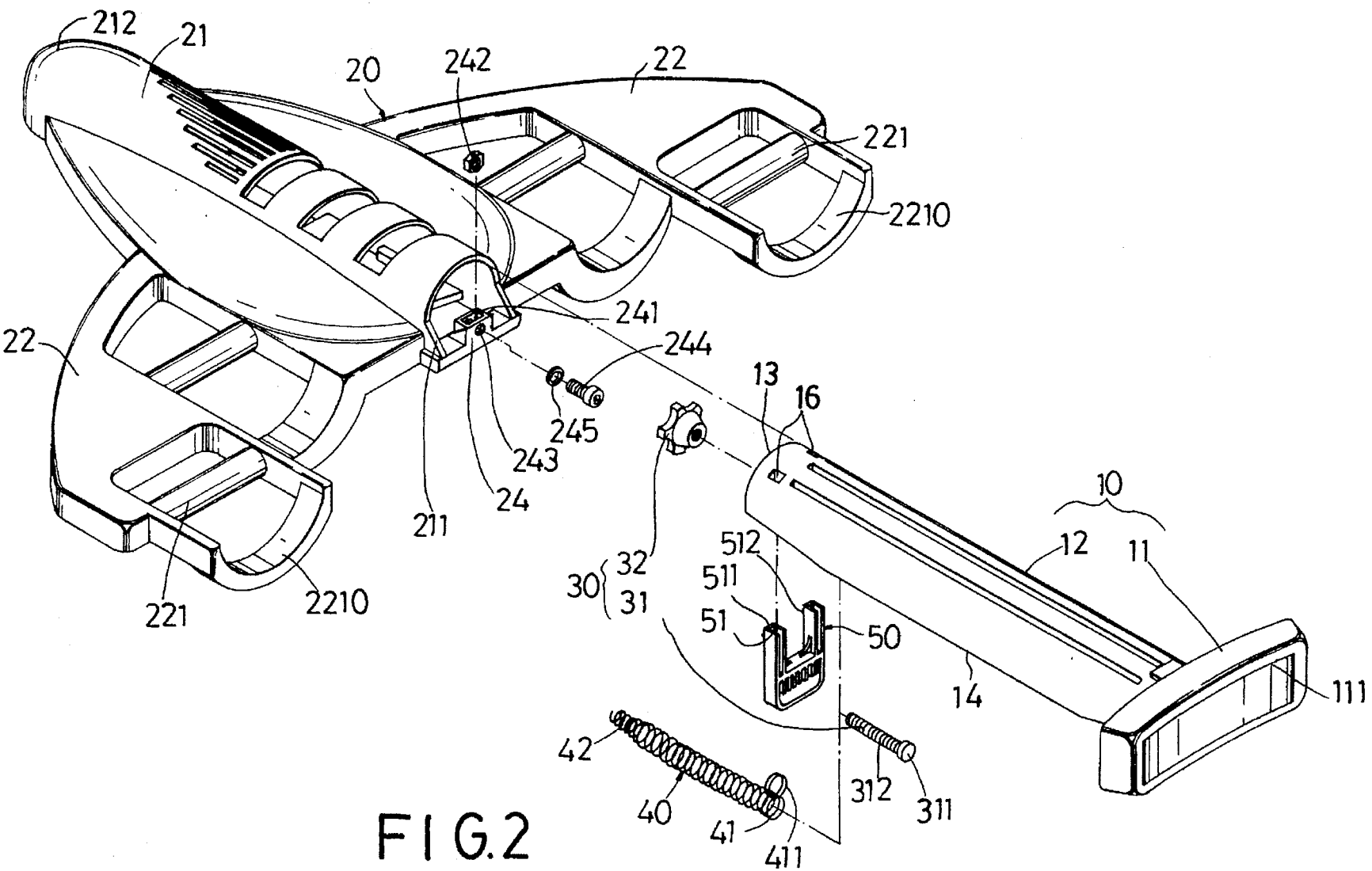
FIG. 2 is a perspective exploded view of a preferred embodiment of a hand-held exerciser according to the present invention.
Figure 3:
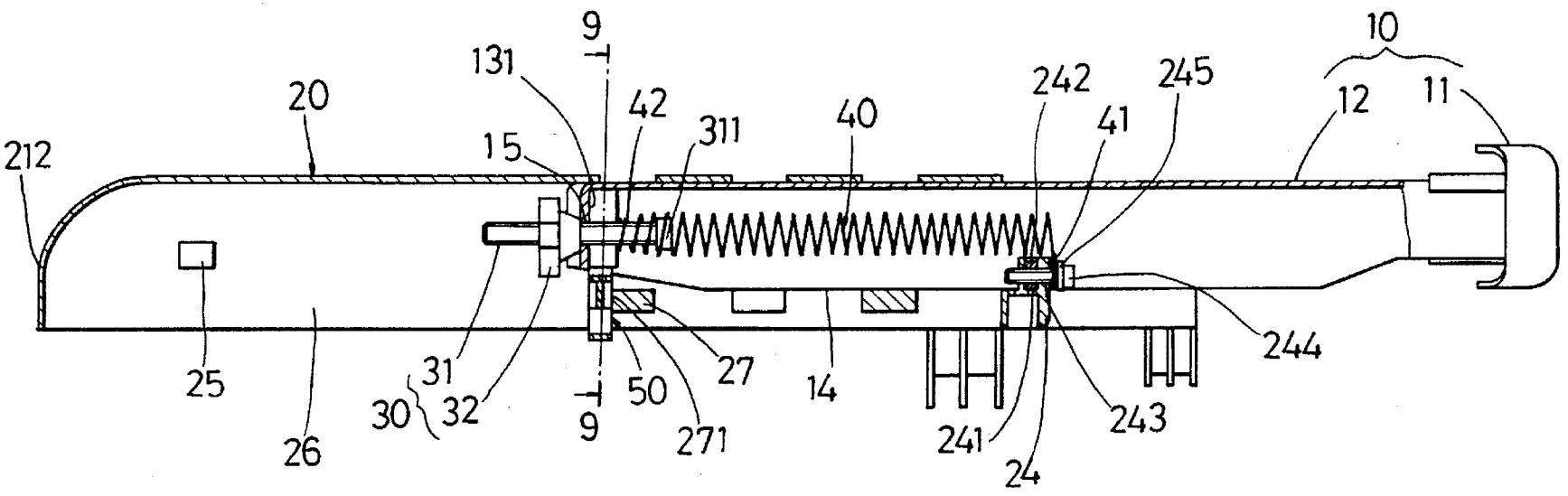
FIG. 3 is a sectional side view of the preferred embodiment of the hand-held exerciser according to the present invention.

Referring to FIGS. 2 and 3, a preferred embodiment of a hand-held exerciser according to the present invention is shown to comprise a fixed body 10, a movable body 20, a spring adjustment device 30 and a coiled spring 40.

Figure 8:
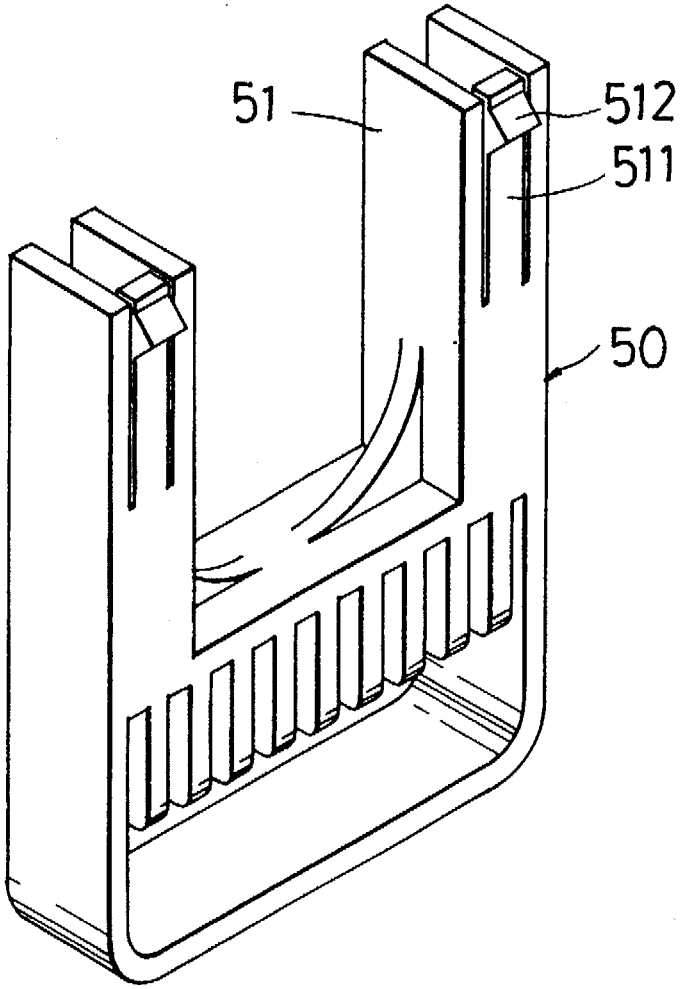
FIG. 8 is a perspective view illustrating the catch member of hand-held exerciser according to the present invention.
Figure 9:
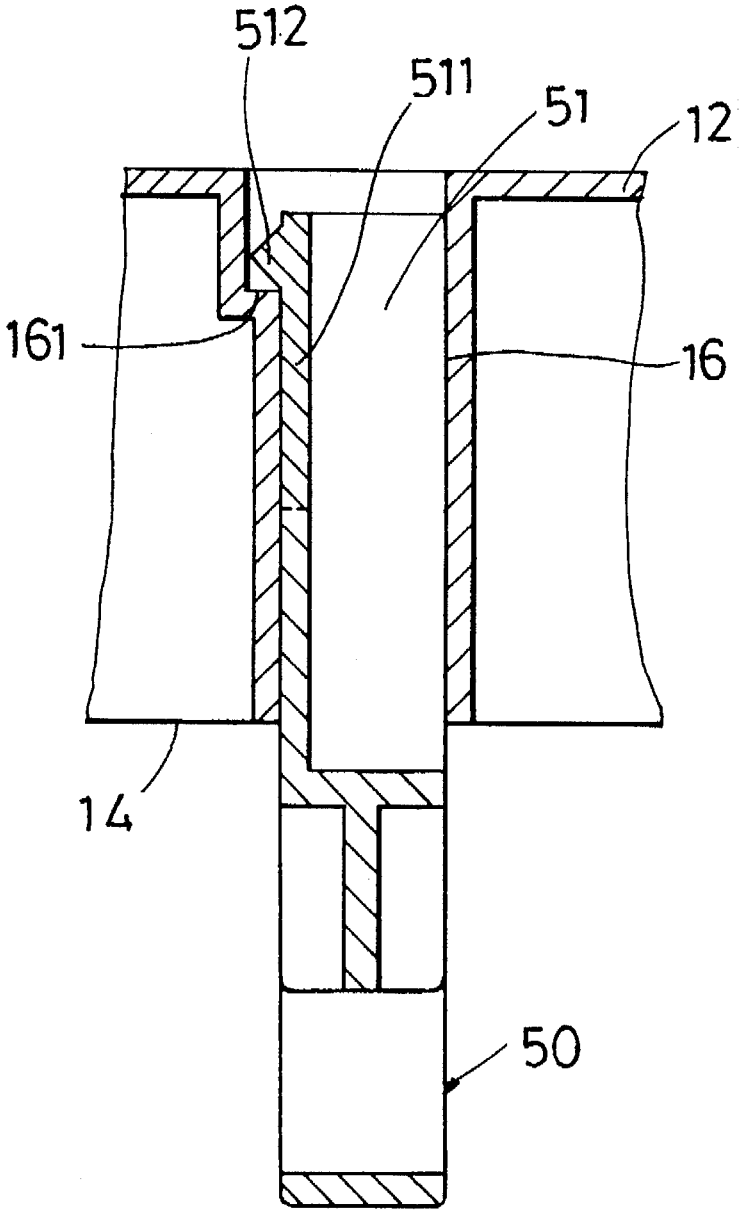
FIG. 9 is a fragmentary sectional view taken along the lines 9—9 of FIG. 3 illustrating how the catch member engages the tube member of the fixed body of the hand-held exerciser according to the present invention.

The fixed body 10 has an abutting plate 11 and a tube member 12 which extends perpendicularly from one of the opposed side faces of the abutting plate 11. The other side face of the abutting plate 11 is formed with an arcuate surface 111 which is adapted to abut against the user's abdomen. The tube member 12 has a longitudinal opening 14 which is formed in the lower portion of the wall thereof and which extends from the distal end thereof toward the abutting plate 11. The distal end 13 has an end plate 131 which is formed with an axial hole 15. The distal end 13 of the tube member 12 has a catch member 50 connected transversely thereto. More specifically, the tube member 12 has two rectangular holes 16 formed transversely therethrough adjacent to the distal end 13 thereof. Each of the holes 15 has a shoulder portion 161 formed therein, as best illustrating in FIG. 9. The catch member 50 is inverted U-shaped with two arm members 51, as best illustrating in FIG. 8. Each of the arm members 51 extends into a respective one of the holes 16 of the tube member 12 and has a resilient retaining hook 511 with a hook end 512 which engages a corresponding one of the shoulder portions 161 in the holes 16 in order to secure the catch member 50 to the tube member 12.

Figure 4:
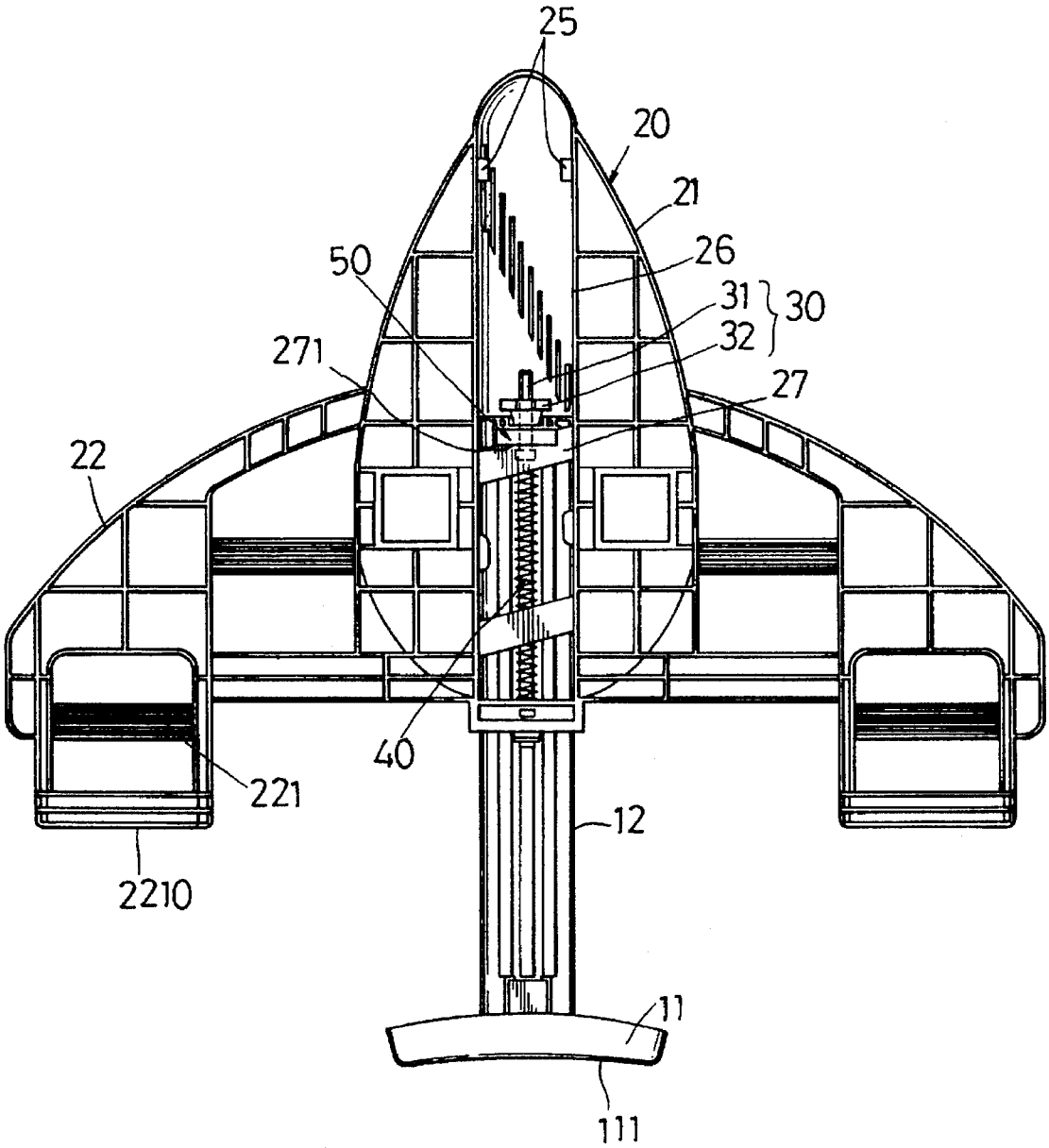
FIG. 4 is a bottom view of the preferred embodiment of the hand-held exerciser according to the present invention.

Referring to FIGS. 2 and 3, the movable body 20 has a central tubular portion 21 and two wing members 22 which are connected to two sides of the central tubular portion 21. Each of the wing members 22 has a handle 221 and an arcuate wrist rest 2210 adjacent the handle 221. The central tubular portion 21 has an open end 211, a closed end 212, an engaging seat fixed 24 adjacent to the open end 211 thereof, a plurality of projections 25 formed on the internal face thereof adjacent to the closed end 212 thereof, as best illustrated in FIGS. 3, 4. The central tubular portion 21 further has an axial notch 26 extending from the closed end 212 thereof along the lower portion of wall thereof to its intermediate section. The tube member 12 of the fixed body 10 is fitted slidably in the central tubular portion 21 of the movable body 20 with the catch member 50 is received slidably in the axial notch 26 of the movable body 20. The distal end 13 of the tube member 12 will be stopped by the projections 25 of the central tubular portion 21 when the tube member 12 is moved into the central tubular portion 21. The central portion of the engaging seat 24 has a cavity 241, a nut 242 is fixed in the cavity 241, an axial through hole 243 which extends transversely through the engaging seat 24 and which is aligned with the central hole of the nut 243, a washer 245 and a screw member 244 extending through the washer 245, the though hole 243 and engaging the nut 242. A plurality of inclined plates 27 are arranged spacedly from the intermediate section of the lower portion of the central tubular portion 21 to the open end 211. The innermost plate 27 has a flat edge which is formed as the bottom end 271 of the axial notch 26, as best illustrated in FIG. 4.

Referring to FIG. 2, 3, the coiled spring 40 is received in the tube member 12 of the fixed body 10 and has a first end 41 with an eye 411 which is connected to the engaging seat 24 of the movable body 20 by means of the screw member 244 and washer 245 and a second end 42 which is connected to the distal end 13 of the tube member 12 in order to urge the catch member 50 to abut against the bottom end 271 of the axial notch 26 of the movable body 20.

Figure 7:
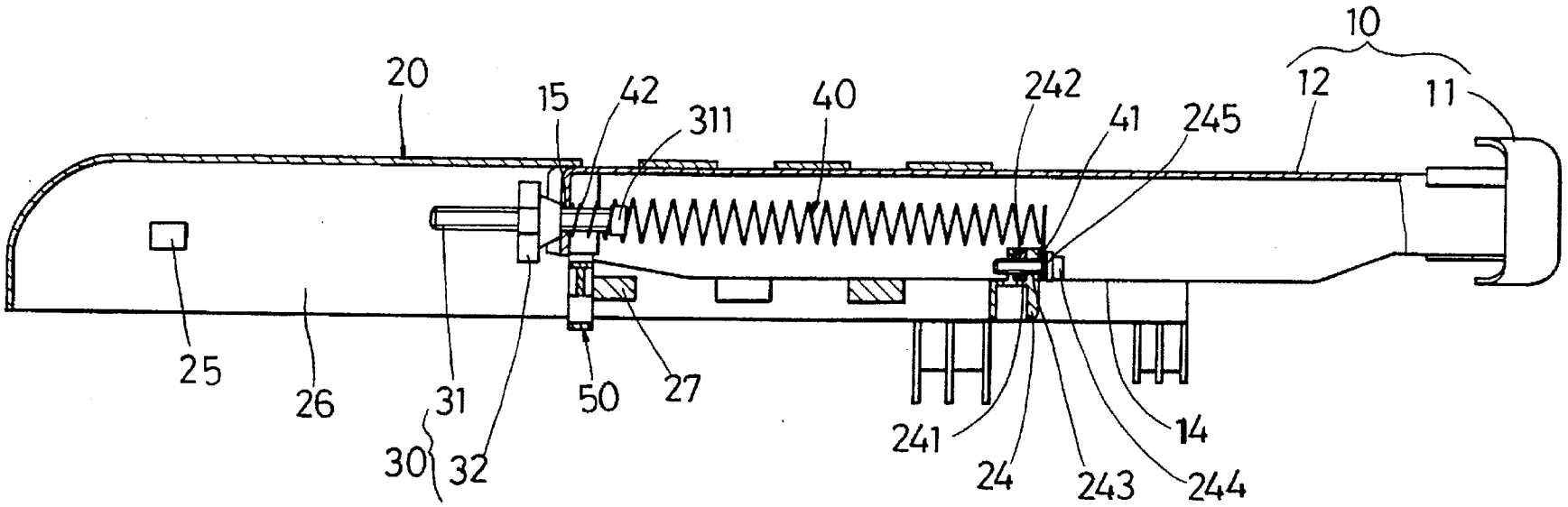
FIG. 7 is a schematic side view illustrating how the spring force of the coiled spring is adjusted according to the present invention.

The spring adjustment device 30 has a bolt 31 with a head 311 and a threaded shaft 312, and a nut member 32. The threaded shaft 312 extends axially through the second end 42 of coiled spring 40 and the axial hole 15 of the distal end 13 of the tube member 15. Because the diameter of the coiled spring 40 is decreased gradually toward the second end 42 of the coiled spring 40 and adjacent the same, the head 311 of the bolt 31 may engage the second end 42 of the coiled spring 40 when the threaded shaft 312 engages the nut member 32. Therefore, the spring force of the coiled spring 40 can be adjusted by means of rotating the nut member 32 in order to move the bolt 31 with respect to the distal end 13 of the tube member 12, as best illustrated in FIG. 7.

Figure 5:
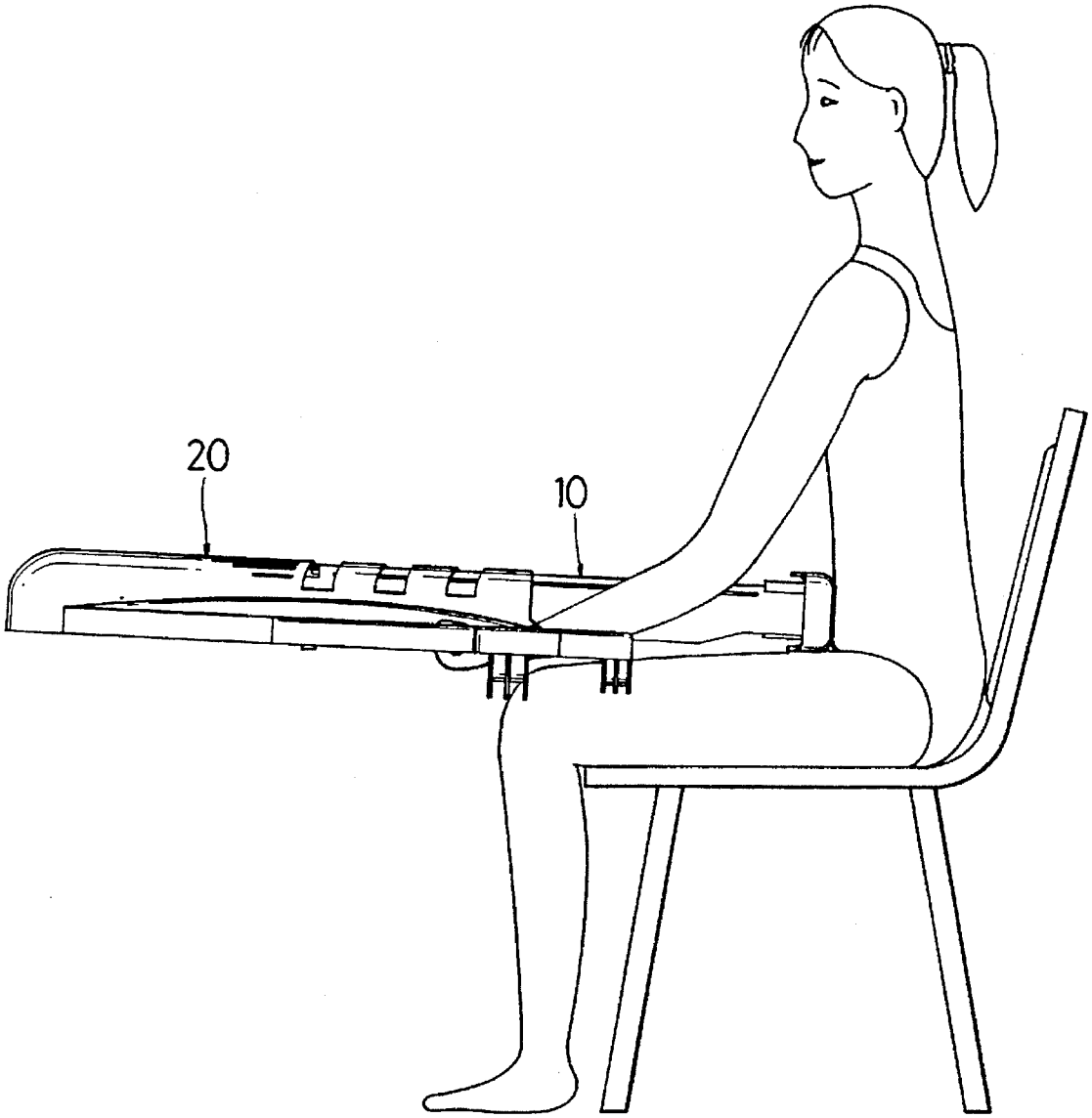
FIG. 5 is a schematic view illustrating how the hand-held exerciser is used according to the present invention.
Figure 6:
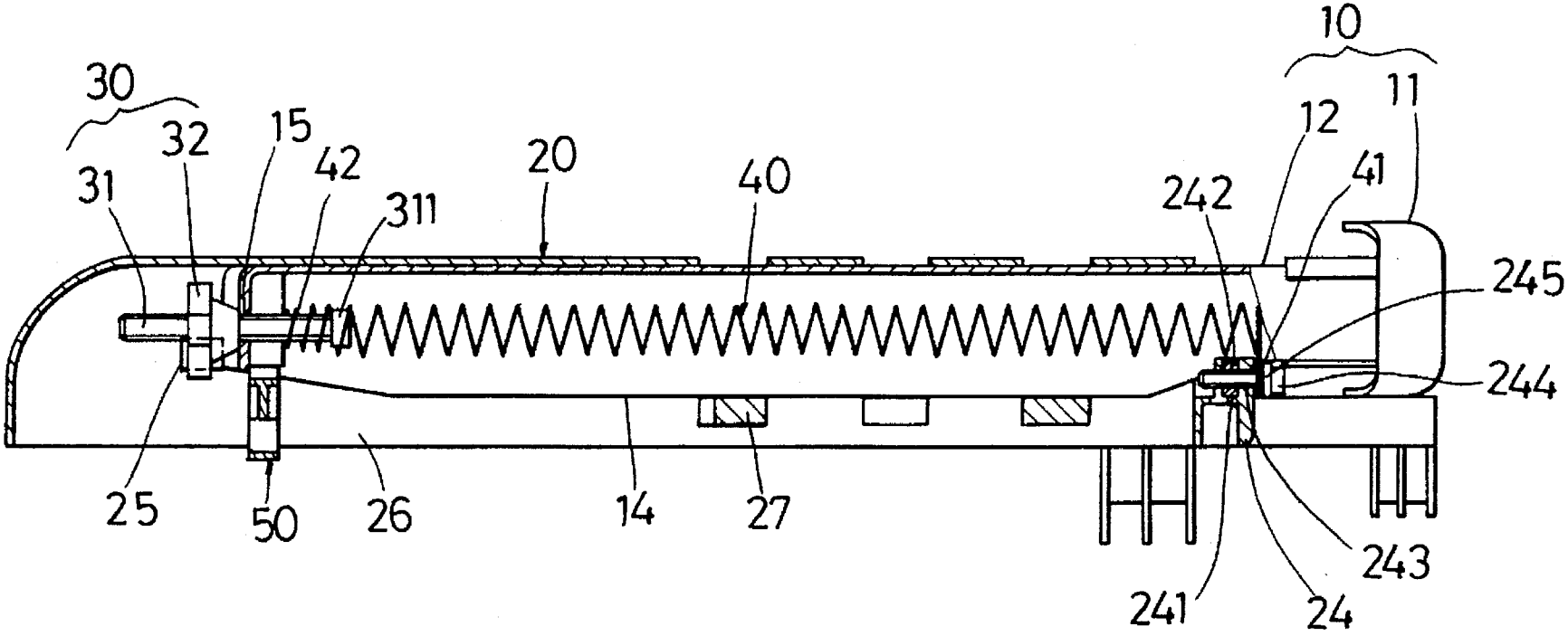
FIG. 6 is a schematic side view illustrating how the movable body is moved relative to the fixed body of the hand-held exerciser according to the present invention.

When in use, with reference to FIG. 5, the user may enable the arcuate surface 111 of the abutting plate 11 to abut against the abdomen and may grasp the handles 221 with his/her wrists resting on the wrist rests 2210. The user then exerts a force on the handles 221 against the spring force of the coiled spring 40 by his/her arms in order to pull the movable body 20 toward the user's body relative to the fixed body 10. At this time, the coiled spring 40 is stretched, as shown in FIG. 6. When the force is released, the movable body 20 will be moved away from the user's body by means of the restore force of the coiled spring 40. In this way, the user can simply exercise the arms without the aid of the user's weight by means of the hand-held exerciser of the present invention.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangement.

I claim:

1. A hand-held exerciser, comprising:

a fixed body having an abutting plate with opposed side faces and a tube member extending perpendicularly from one of said side faces of said abutting plate, said tube member having a distal end, a wall and a longitudinal opening which is formed in said wall thereof and which extends from said distal end thereof toward said abutting plate, said distal end of said tube member having a catch member connected transversely thereto, said tube member having two holes formed transversely therethrough adjacent to said distal end thereof, each of said holes having a shoulder portion formed therein, said catch member being inverted U-shaped with two arm members, each of said arm members extending into a respective one of said holes of said tube member and having a retaining hook with a hook end which engages a corresponding one of said shoulder portions in said holes in order to secure said catch member to said tube member;

a moveable body having a central tubular portion and two wing members connected to two sides of said central tubular portion, each of said wing members being formed with a handle, said central tubular portion having an open end, a closed end, an engaging seat fixed adjacent to said open end thereof, a plurality of projections formed on an internal face thereof adjacent to said closed end thereof, and an axial notch extending from said closed end thereof, said axial notch having a bottom end which is formed at an intermediate section of said central tubular portion, said tube member of said fixed body being fitted slidably in said central tubular portion of said movable body with said catch member of said fixed body being received slidably in said axial notch of said movable body; and a coiled spring received in said tube member of said fixed body and having a first end which is connected to said engaging seat of said movable body and a second end which is connected to said distal end of said tube member in order to urge said catch member to abut against said bottom end of said axial notch of said movable body.

2. A hand-held exerciser, comprising:

a fixed body having an abutting plate with opposed side faces and a tube member extending perpendicularly from one of said side faces of said abutting plate, said tube member having a distal end, a wall and a longitudinal opening which is formed in said wall thereof and which extends from said distal end thereof toward said abutting plate, said distal end of said tube member having a catch member connected transversely thereto;

a moveable body having a central tubular portion and two wing members connected to two sides of said central tubular portion, each of said wing members being formed with a handle, said central tubular portion having an open end, a closed end, an engaging seat fixed adjacent to said open end thereof, a plurality of projections formed on an internal face thereof adjacent to said closed end thereof, and an axial notch extending from said closed end thereof, said axial notch having a bottom end which is formed at an intermediate section of said central tubular portion, said tube member of said fixed body being fitted slidably in said central tubular portion of said movable body with said catch member of said fixed body being received slidably in said axial notch of said movable body; and a coiled spring received in said tube member of said fixed body and having first end which is connected to said engaging seat of said movable body and a second end which is connected to said distal end of said tube member in order to urge said catch member to about against said bottom end of said axial notch of said movable body;

wherein said distal end of said tube member has a spring adjustment device mounted thereto, said spring adjustment device having a bolt with a head and a threaded shaft, and a nut member, said threaded shaft extending axially through said second end of coiled spring and said distal end of said tube member and engaging said nut member with said head of said bolt engaging said second end of said coiled spring.

* * * * *